US005613375A

United States Patent [19]

Renda et al.

[11] Patent Number: 5,613,375

[45] Date of Patent: Mar. 25, 1997

[54] CONVERTIBLE CIRCULAR KNITTING MACHINE

[75] Inventors: Philip Renda, Charlotte; James R. Earnhardt, Jr., Salisbury; Bill R. Anderson, Winston-Salem; Sonny B. Driggars, Advance, all of N.C.

[73] Assignee: Sara Lee Corporation, Winston-Salem, N.C.

[21] Appl. No.: 555,926

[22] Filed: Nov. 13, 1995

[51] Int. Cl.[6] ..... D04B 15/00

[52] U.S. Cl. ..... 66/8; 66/19; 66/57

[58] Field of Search ..... 66/8, 19, 57

[56] References Cited

U.S. PATENT DOCUMENTS

| | | | |
|---|---|---|---|
| 3,273,359 | 9/1966 | Fregeolle | 66/8 |
| 3,670,526 | 6/1972 | Martinez | 66/57 X |
| 3,817,058 | 6/1974 | Lombardi | 66/8 |
| 5,138,848 | 8/1992 | Schnurrer et al. | 66/57 |
| 5,172,569 | 12/1992 | Schnurrer | 66/57 X |

FOREIGN PATENT DOCUMENTS

| | | | |
|---|---|---|---|
| 4129845 | 3/1993 | Germany | 66/19 |
| 1406262 | 9/1975 | United Kingdom | 66/19 |

OTHER PUBLICATIONS

Stibbe Introduces SB Range of Interchangeable CAM Models, Knitting Times, Feb. 7, 1977, p. 52.

*Primary Examiner*—John J. Calvert
*Attorney, Agent, or Firm*—Rhodes Coats & Bennett, L.L.P.

[57] ABSTRACT

A convertible circular knitting machine having a creel and feeders which is adapted to be converted from producing fleece fabric to producing jersey fabric or back. The apparatus includes a knitting cylinder adapted to receive a plurality of knitting needles and a bed for supporting the cylinder. A plurality of fleece section blocks are adapted to be attached to the bed and arranged along the perimeter of the cylinder to produce fleece fabric. The apparatus also includes a plurality of jersey section blocks each having the same number of feeders and peripheral dimensions as each fleece section block and adapted to be attached to the bed and arranged along the perimeter of the cylinder to produce jersey and a plurality of fleece sinkers for use with the fleece section blocks for producing fleece fabric and a plurality of jersey sinkers for use with the jersey section blocks for producing jersey fabric. As a result, the circular knitting machine may be converted from producing fleece fabric to producing jersey fabric or back without extensive modifications or replacement of the creel, feeders or cylinder.

25 Claims, 6 Drawing Sheets

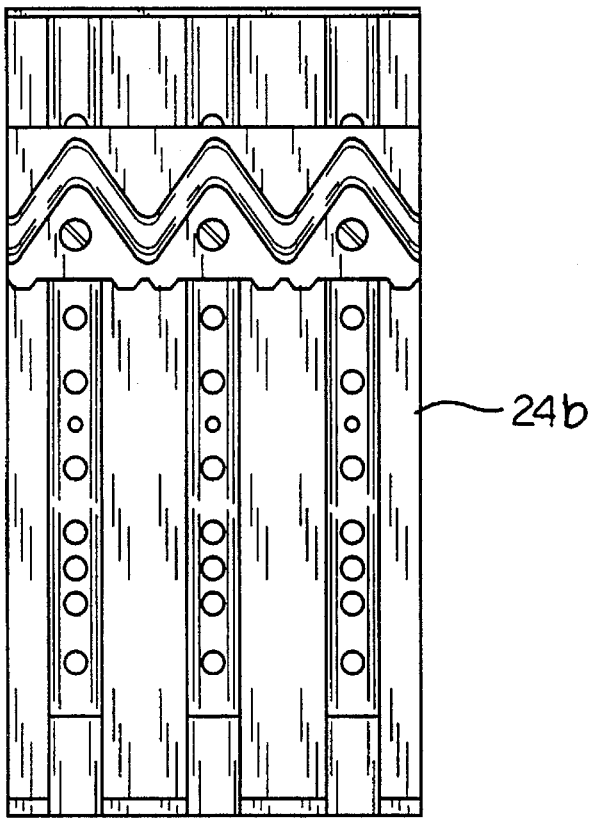
FIG. 3B
FIG. 3C
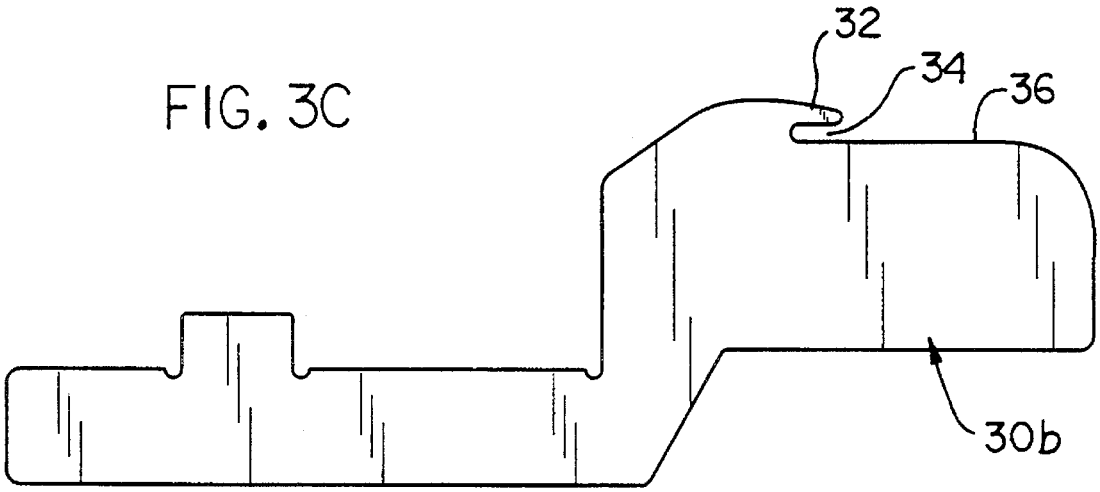

| 13 CUT FLEECE TO 17 CUT JERSEY | | | EQUIVALENT TO 13 CUT FLEECE | | | EQUIVALENT TO 22 CUT JERSEY | | |
|---|---|---|---|---|---|---|---|---|
| SIZE | NEEDLES | CURRENT | SIZE | NEEDLES | CURRENT | SIZE | NEEDLES | CURRENT |
| 13" | 696 | | 17" | 696 | 696 | 10" | 696 | 696 |
| | | | | | | | | |
| 14" | 756 | | 18" | 756 | Δ 744 | 11" | 756 | 756 |
| | | | | | | | | |
| 16" | 828 | Δ 804 | 20" | 828 | 828 | 12" | 828 | 828 |
| | | | | | | | | |
| 17" | 854 | 854 | 21" | 864 | 864 | | | |
| | | | | | | | | |
| 18" | 900 | 900 | 22" | 900 | Δ 912 | 13" | 900 | 900 |
| | | | | | | | | |
| 19" | 972 | | 23" | 972 | Δ 960 | 14" | 972 | 972 |
| | | | | | | | | |
| 20" | 1044 | 1044 | 25" | 1044 | Δ 1020 | 15" | 1044 | Δ 1032 |
| | | | | | | | | |
| 21" | 1104 | | 26" | 1104 | Δ 1080 | 16" | 1104 | 1104 |
| | | | | | | | | |
| 22" | 1160 | 1160 | 28" | 1160 | Δ 1164 | | | |
| | | | | | | | | |
| 23" | 1176 | | 28" | 1176 | Δ 1164 | 17" | 1176 | 1176 |
| | | | | | | | | |
| 24" | 1276 | 1276 | 30" | 1276 | Δ 1248 | 18" | 1276 | Δ 1248 |

FIG. 4

CONVERTIBLE CIRCULAR KNITTING MACHINE

BACKGROUND OF THE INVENTION (1) Field of the Invention

The present invention relates generally to circular knitting machines and, more particularly, to a circular knitting machine having a single cylinder and interchangeable section blocks and sinkers which permit easy conversion between production of fleece and jersey fabrics.

(2) Description of the Prior Art

The term circular knitting covers those weft knitting machines having needle beds arranged in circular cylinders and/or dials including latch, bearded and occasionally compound needle machinery. Such machines produce a wide variety of fabric structures, garments, hosiery and other articles and a variety of diameters and machine gauges. Such machines have the needles fixed in a revolving circle with the loop formation and knitting action being achieved by ancillary elements moving yarn and loops along the needle stems producing a fabric tube with the technical face facing backwards.

Large diameter circular knitting machines are generally used to produce either fleece or jersey fabrics as well as other fabric constructions. Because of the seasonal nature of these fabrics, it is usually necessary to maintain both fleece and jersey machines on the knitting floor or to move machines in and out as seasonal fabric demands change. Both approaches are capital and labor cost intensive.

It is possible with present technology to convert a fleece circular knitting machine to a jersey circular knitting machine, however, this generally requires disassembling the machine down to its bed and replacing the cylinder, section blocks, the carrier ring, needles and sinkers, and often the creel and feeders. At the present time, this is about a 20-hour task for two men. With normally about 50 machines on the floor of a medium size facility, it would take ½ man year and about $15,000 per machine to make such a changeover. This is impractical.

Thus, there remains a need for a new and improved circular knitting machine having interchangeable section blocks and sinkers which allow the machine to be converted between producing fleece and jersey fabrics by simply replacing the section blocks, carrier ring, needles and sinkers without the need to strip the machine to its bed or to change the feeders or creel.

SUMMARY OF THE INVENTION

The present invention is directed to a convertible circular knitting machine having a creel and feeders which is adapted to be converted from producing fleece fabric to producing jersey fabric or back. The apparatus includes a knitting cylinder adapted to receive a plurality of knitting needles and a bed for supporting the cylinder. A plurality of fleece section blocks are adapted to be attached to the bed and arranged along the perimeter of the cylinder to produce fleece fabric.

The apparatus also includes a plurality of jersey section blocks each having the same number of feeders and peripheral dimensions as each fleece section block and adapted to be attached to the bed and arranged along the perimeter of the cylinder to produce jersey and a plurality of fleece sinkers for use with the fleece section blocks for producing fleece fabric and a plurality of jersey sinkers for use with the jersey section blocks for producing jersey fabric. As a result, the circular knitting machine may be converted from producing fleece fabric with the fleece section blocks to producing jersey fabric with the jersey section blocks or back without extensive modifications or replacement of the creel, feeders or cylinder.

Accordingly, one aspect of the present invention is to provide a circular knitting machine having a creel and feeders which is adapted to be converted from producing fleece fabric to producing jersey fabric or back. The apparatus includes: (a) a knitting cylinder adapted to receive a plurality of knitting needles; (b) a bed for supporting the cylinder; (c) a plurality of fleece section blocks adapted to be attached to the bed and arranged along the perimeter of the cylinder; and (d) a plurality of jersey section blocks each having the same number of feeders as each fleece section block and adapted to be attached to the bed and arranged along the perimeter of the cylinder; whereby, the circular knitting machine may be converted from producing fleece fabric with the fleece section blocks to producing jersey fabric with the jersey section blocks or back.

Another aspect of the present invention is to provide a conversion kit for a circular knitting machine having a creel and feeders; a knitting cylinder adapted to receive a plurality of knitting needles; a bed for supporting the cylinder; and a plurality of fleece section blocks adapted to be attached to the bed and arranged along the perimeter of the cylinder. The apparatus includes: a plurality of jersey section blocks each having the same number of feeders and peripheral dimensions as each fleece section block and adapted to be attached to the bed and arranged along the perimeter of the cylinder; whereby, the circular knitting machine may be converted from producing fleece fabric with the fleece section blocks to producing jersey fabric with the jersey section blocks or back.

Still another aspect of the present invention is to provide a circular knitting machine having a creel and feeders which is adapted to be converted from producing fleece fabric to producing jersey fabric or back. The apparatus includes: (a) a knitting cylinder adapted to receive a plurality of knitting needles; (b) a bed for supporting the cylinder; (c) a plurality of fleece section blocks adapted to be attached to the bed and arranged along the perimeter of the cylinder; (d) a plurality of jersey section blocks each having the same number of feeders and peripheral dimensions as each fleece section block and adapted to be attached to the bed and arranged along the perimeter of the cylinder; and (e) a plurality of fleece sinkers for use with the fleece section blocks for producing fleece fabric and a plurality of jersey sinkers for use with the jersey section blocks for producing jersey fabric; whereby, the circular knitting machine may be converted from producing fleece fabric with the fleece section blocks to producing jersey fabric with the jersey section blocks or back.

These and other aspects of the present invention will become apparent to those skilled in the art after a reading of the following description of the preferred embodiment when considered with the drawings.

BRIEF DESCRIPTION OF THE DRAWINGS

FIG. 3*b* is an enlarged back view of the modified jersey section block illustrated in FIG. 3*a;*

FIG. 3*c* is an enlarged side view illustrating the modified jersey sinker constructed according to the present invention; and FIG. 4 is a chart showing the relationships between converting 13 cut fleece to 17 cut jersey.

DESCRIPTION OF THE PREFERRED EMBODIMENTS

Figure 1:
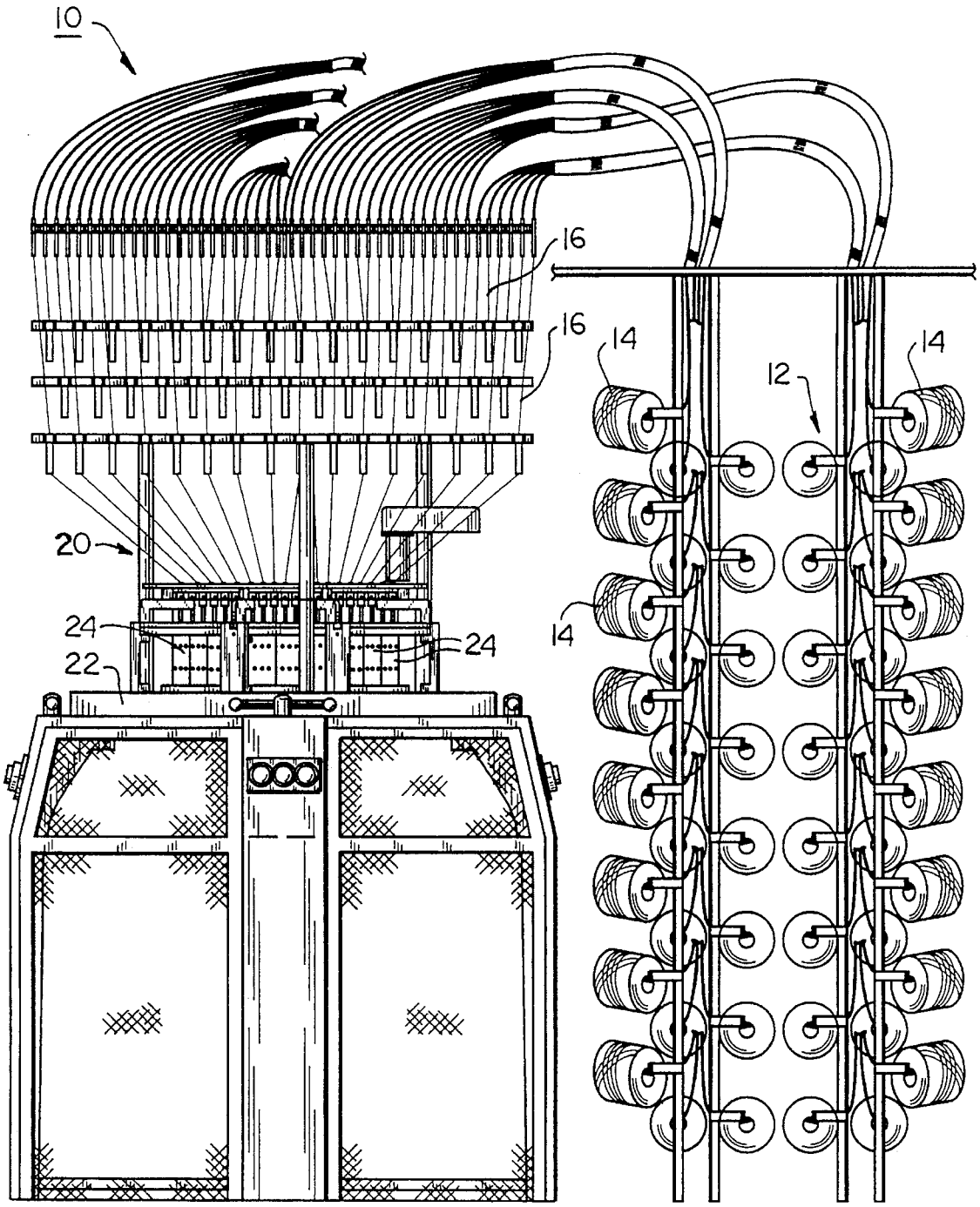
FIG. 1 is a front view illustrating a conventional fleece circular knitting machine adaptable to be converted to a jersey circular knitting machine according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a conventional fleece circular knitting machine adaptable to be converted to a jersey circular knitting machine, generally designated 10, is shown constructed according to the present invention. The knitting machine 10 includes four major sub-assemblies: a creel 12 having a plurality of yarn packages 14; a plurality of feeders 16; a knitting cylinder 20 supported on a bed 22 and having a plurality of needles (not shown); and a plurality of fleece section blocks 24 attached to the bed and arranged about the perimeter of said cylinder.

The present invention is directed to converting a four track fleece circular knitting machine to jersey fabric. Jersey fabric is usually knit on four feeds per block. It has been found that it is possible to design jersey cams and section blocks that are interchangeable with the fleece section blocks. This allows one cylinder to produce two types of fabric with the same cylinder. All that is necessary is to replace the interchangeable section blocks, the carrier ring, and the needles and sinkers. The cut remains the same as well as the creel and number of feeders. While the resulting jersey machine has fewer feeds, it is possible to speed up the converted machine because of gentler cam angles to produce approximately the same amount of fabric.

Figure 2A:
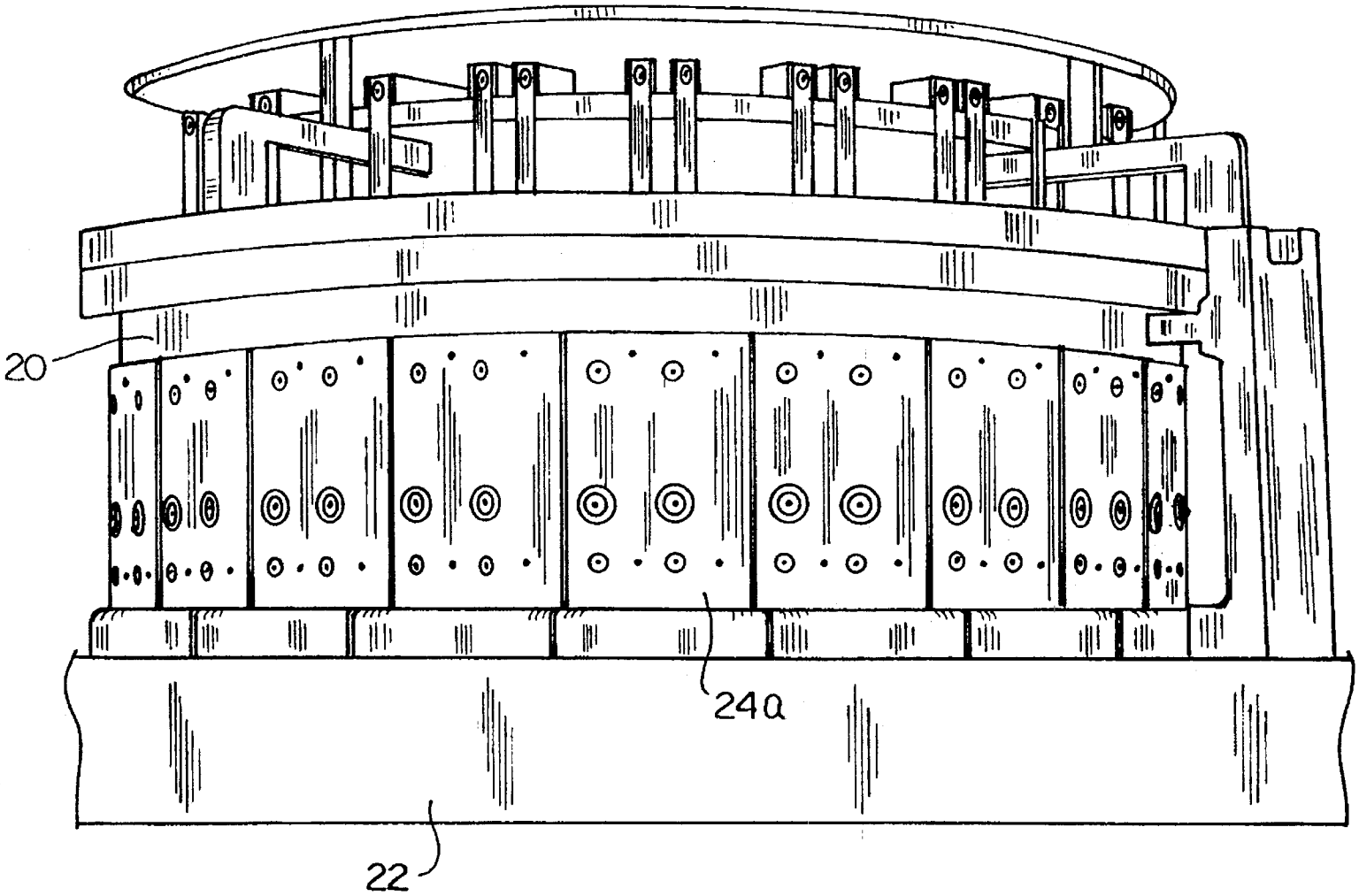
FIG. 2*a* is an enlarged front view illustrating a conventional fleece section block having two dials associated with two upper feeds each supplying one yarn and a third yarn being supplied to the fleece sinker.
Figure 2B:
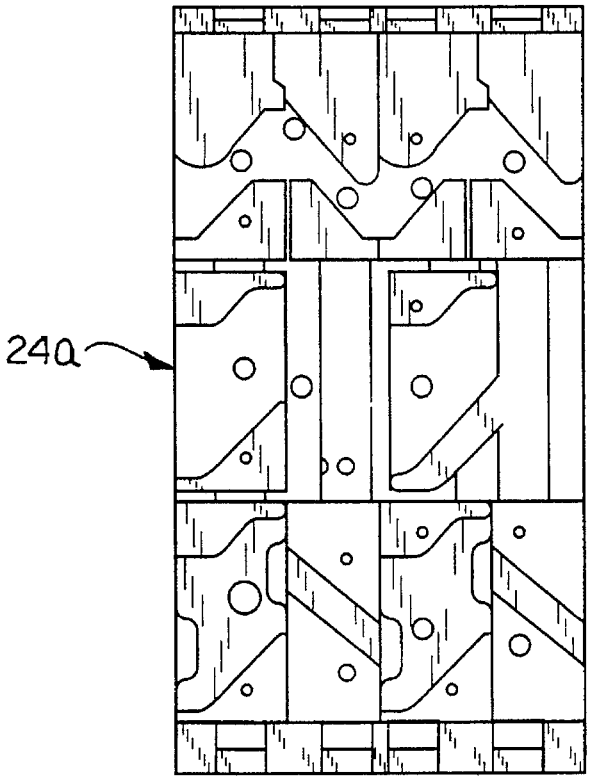
FIG. 2*b* is an enlarged back view of the conventional fleece section block illustrated in FIG. 2*a;*
Figure 2C:
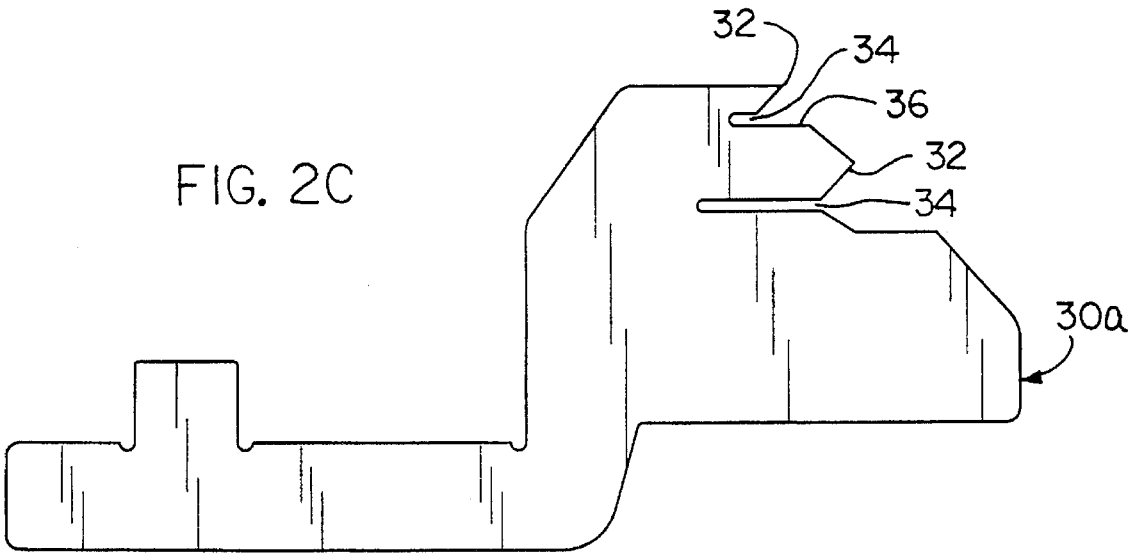
FIG. 2*c* is an enlarged side view illustrating a conventional fleece sinker.
Figure 3A:
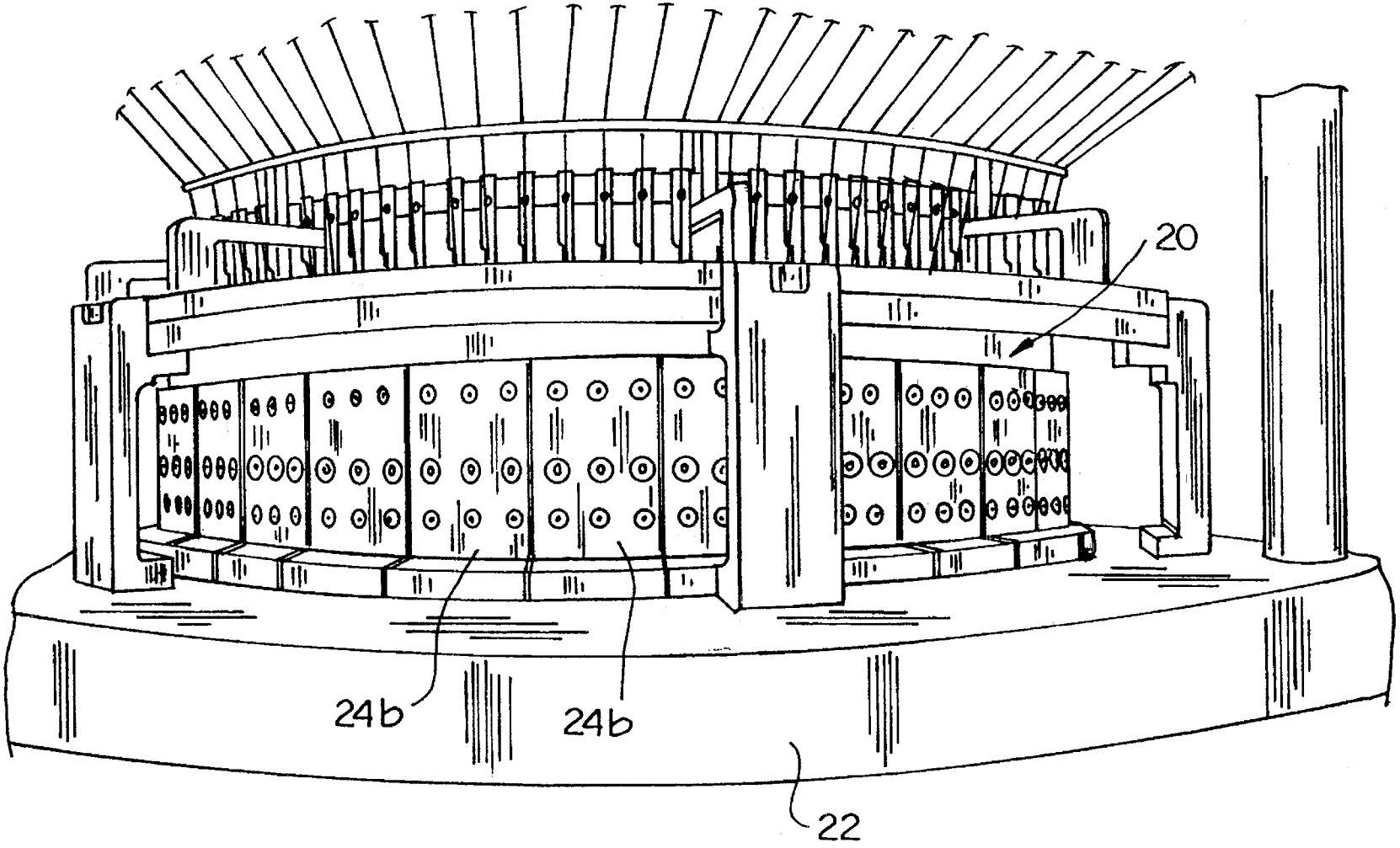
FIG. 3*a* is an enlarged front view illustrating the modified jersey section block constructed according to the present invention having three dials associated with three upper feeds each supplying one yarn.

In the drawings, FIGS. 2*a*, 2*b*, and 2*c* are directed to the fleece knitting components, whereas FIGS. 3*a*, 3*b*, and 3*c* are directed to the jersey knitting components. The circular knitting machine constructed according to the present invention has a single cylinder 20, interchangeable fleece and jersey section blocks, respectively 24*a* and 24*b*, and interchangeable fleece and jersey sinkers, respectively 30*a* and 30*b*. The circular knitting machine has an associated creel and associated feeders with it which remain the same for both fleece and jersey fabric. The single cylinder accepts either a set of fleece needles or a set of jersey needles that fit in with it.

The jersey section block 24*a* itself that replaces the fleece block 24*a* includes a block, key, cams (three cams per block) and the same number of yarns per block. (See FIG. 3*b*). One yarn per feed and three feeds or cams per block. However, it is possible to introduce two yarns to it to produce a fabric that had cotton on the inside of the garment and a shiny yarn on the exterior. The fleece 30*a* and jersey 30*b* sinkers are different but have the same outer dimensions to allow the modified jersey sinker 30*b* to run jersey on the fleece cylinder. Certain heights and positions are modified because the fleece cylinder is somewhat different than that of a jersey cylinder so that the jersey sinker 30*b* is custom-made to bridge that gap from the fleece cylinder to the jersey cylinder.

Turning to FIG. 2*a*, there is shown an enlarged front view illustrating a conventional fleece section block 24*a* having two dials associated with two upper feeds each supplying one yarn and a third yarn being supplied to the fleece sinker 30*a*. It puts the loop in, i.e. the yarn that gets napped for the pile. The fleece section block 24*a* has a guide on top of the sinker section which feeds yarn into the sinker and the sinker determines the length of the loop it's going to make.

As best seen in FIG. 3*a*, there is shown an enlarged front view illustrating the modified jersey section block 24*b* constructed according to the present invention having three dials associated with three upper feeds each supplying one yarn. When the fleece machine is switched to produce jersey fabric, the sinker feed is changed and each raising cam is individually controlled by an adjusting screw on the end of the dial. Above it on the sinkers is a cam that is designed specifically for that raising cam below it to knit the jersey fabric.

In knitting fleece, it is necessary to have three yarns to make one course. Only one yarn is necessary to knit a course of jersey fabric. Accordingly, one cam and one yarn will knit one course of jersey fabric. Three cams in each block would make three courses of jersey fabric. Three times 36 jersey section blocks would make 108 courses per cylinder revolution. The more cams around the circumference, the more production.

In the present invention, the fleece needles in the cylinder are replaced with jersey needles. A fleece needle has two butts on it, one butt rides on a common track to make the face fabric and then below that is a second butt that will select one of four different needles. The second butt makes the loop, on track 1, 2, 3 or 4. For fleece, you set 1, 2, 3 or 4 diagonally coming down to make the loop on the fleece. On the jersey, it's a single butt and a shorter needle.

The modified jersey section block 24*b* of the present invention is a conventional design, but the dimensions are the same as the fleece section block 24*a* it replaces, including the mounting holes. In the preferred embodiment, the modified jersey section block 24*b* includes the capability of housing four cams per feed which would allow it to make a pattern. As a result, for a 17-cut jersey fabric the same cylinder can be used to make both fleece and jersey fabrics. A comparison of the fleece sinker 30*a* and the modified jersey sinker 30*b* of the present invention is shown in FIGS. 2*c* and 3*c*.

As can be seen, the fleece sinkers 30*a* are adapted for use with the fleece section blocks 24*a* for producing fleece fabric and the jersey sinkers 30*b* are adapted for use with the jersey section blocks 24*b* for producing jersey fabric. Each of the fleece sinkers 30*a* and each of the jersey sinkers 30*b* includes a nose 32, a first throat 34 below the nose and a knit line 36 adjacent to the throat. Each of the fleece sinkers and each of the jersey sinkers have substantially the same outer dimensions to facilitate conversion of the circular knitting machine between production of fleece and jersey fabrics.

In the preferred embodiment, a four-track fleece machine having 36 blocks with three yarns per block (a total of 108 feeds) is converted to a jersey knitting fabric having the same number of feeds and the same creel. FIG. 4 is a chart showing the relationships between converting 13 cut fleece to 17 cut jersey.

This reduces the time necessary to convert a machine from 20 hours to 4–5 hours for a two-man team. To the contrary, current conversion kits require a cylinder, section blocks, carrier ring, needles, creels, sinkers and feed changes which cost about $15,000 per machine and can only be converted at about four machines a week. With normally about 50 machines on the floor, this is impractical to convert back and forth. However, the present invention allows a fleece circular knit machine to be converted to a jersey circular knitting machine or back in about 4 hours, which is five times faster.

In operation, the fleece section blocks 24*a* are removed from around the cylinder 20. Next the fleece needles are replaced with the jersey needles. The modified jersey section blocks 24*a* and jersey sinkers 30*b* are then attached around the cylinder. The cylinder, creel 12 and feeders 16 remain substantially the same. The circular knitting machine is then ready to knit jersey fabric.

Certain modifications and improvements will occur to those skilled in the art upon a reading of the foregoing description. By way of example, while the examples shown have been directed to converting a fleece machine to a jersey machine, the apparatus and techniques of the present invention could also be used to convert a jersey machine to a fleece machine. It should be understood that all such modifications and improvements have been deleted herein for the sake of conciseness and readability but are properly within the scope of the following claims.

We claim:

1. A circular knitting machine having a creel and feeders which is convertible from producing fleece fabric to producing jersey fabric or back, said apparatus comprising:

(a) a knitting cylinder for receiving a plurality of knitting needles;

(b) a bed for supporting said cylinder;

(c) a plurality of fleece section blocks for attachment to said bed and arranged along said cylinder at a perimeter thereof; and (d) a plurality of jersey section blocks each having the same number of feeders as each fleece section block and each attachable to said bed and arranged along the perimeter of said cylinder;

whereby, said circular knitting machine may be converted from producing fleece fabric with said fleece section blocks to producing jersey fabric with said jersey section blocks or back.

2. The apparatus according to claim 1, further including a plurality of fleece sinkers for use with said fleece section blocks for producing fleece fabric and a plurality of jersey sinkers for use with said jersey section blocks for producing jersey fabric.

3. The apparatus according to claim 2, wherein each of said fleece sinkers and each of said jersey sinkers include a nose, a first throat below said nose and a knit line adjacent to said throat.

4. The apparatus according to claim 3, wherein each of said fleece sinkers and each of said jersey sinkers have substantially the same outer dimensions to facilitate conversion of said machine between production of fleece and jersey fabrics.

5. The apparatus according to claim 1, wherein the creel is adapted to support a plurality of yarn packages.

6. The apparatus according to claim 5, wherein the feeders are adapted to receive yarn from said plurality of yarn packages.

7. The apparatus according to claim 6, wherein the number of feeders adapted to receive yarn from said plurality of yarn packages is substantially the same as the number of yarn packages.

8. The apparatus according to claim 7, wherein the number of feeders adapted to receive yarn from said plurality of yarn packages is about 3 for each fleece section block.

9. The apparatus according to claim 1, further including a plurality of fleece needles for use with said fleece section blocks for producing fleece fabric and a plurality of jersey needles for use with said jersey section blocks for producing jersey fabric.

10. A conversion kit for a circular knitting machine having a creel and feeders; a knitting cylinder for receiving a plurality of knitting needles; a bed for supporting said cylinder; and a plurality of fleece section blocks for attachment to said bed and arranged along said cylinder at a perimeter thereof, said apparatus comprising: a plurality of jersey section blocks each having an equal number of feeders and peripheral dimensions as each fleece section block and each attachable to said bed and arranged along the perimeter of said cylinder; whereby, said circular knitting machine may be converted from producing fleece fabric with said fleece section blocks to producing jersey fabric with said jersey section blocks or back.

11. The apparatus according to claim 10, further including a plurality of fleece sinkers for use with said fleece section blocks for producing fleece fabric and a plurality of jersey sinkers for use with said jersey section blocks for producing jersey fabric.

12. The apparatus according to claim 11, wherein each of said fleece sinkers and each of said jersey sinkers include a nose, a first throat below said nose and a knit line adjacent to said throat.

13. The apparatus according to claim 12, wherein each of said fleece sinkers and each of said jersey sinkers have substantially the same outer dimensions to facilitate conversion of said machine between production of fleece and jersey fabrics.

14. The apparatus according to claim 10, further including a plurality of jersey needles for use with said jersey section blocks for producing jersey fabric.

15. A circular knitting machine having a creel and feeders which is convertible from producing fleece fabric to producing jersey fabric or back, said apparatus comprising:

(a) a knitting cylinder for receiving a plurality of knitting needles;

(b) a bed for supporting said cylinder;

(c) a plurality of fleece section blocks for attachment to said bed and arranged along of said cylinder at a perimeter thereof;

(d) a plurality of jersey section blocks each having an equal number of feeders and peripheral dimensions as each fleece section block and each attachable to said bed and arranged along the perimeter of said cylinder; and (e) a plurality of fleece sinkers for use with said fleece section blocks for producing fleece fabric and a plurality of jersey sinkers for use with said jersey section blocks for producing jersey fabric;

whereby, said circular knitting machine may be converted from producing fleece fabric with said fleece section blocks to producing jersey fabric with said jersey section blocks or back.

16. The apparatus according to claim 15, wherein each of said fleece sinkers and each of said jersey sinkers include a nose, a first throat below said nose and a knit line adjacent to said throat.

17. The apparatus according to claim 16, wherein each of said fleece sinkers and each of said jersey sinkers have substantially the same outer dimensions to facilitate conversion of said machine between production of fleece and jersey fabrics.

18. The apparatus according to claim 15, wherein the creel is adapted to support a plurality of yarn packages.

19. The apparatus according to claim 18, wherein the feeders are adapted to receive yarn from said plurality of yarn packages.

20. The apparatus according to claim 19, wherein the number of feeders adapted to receive yarn from said plurality of yarn packages is substantially the same as the number of yarn packages.

21. The apparatus according to claim 20, wherein the number of feeders adapted to receive yarn from said plurality of yarn packages is about 3 for each fleece section block.

22. The apparatus according to claim 15, further including a plurality of fleece needles for use with said fleece section blocks for producing fleece fabric and a plurality of jersey needles for use with said jersey section blocks for producing jersey fabric.

23. A method for converting a circular knitting machine having a creel and feeders from producing fleece fabric, said machine further including: a knitting cylinder for receiving a plurality of knitting needles; a bed for supporting said cylinder; and a plurality of fleece section blocks for attachment to said bed and arranged along of said cylinder at a perimeter thereof; to producing jersey fabric or back, said method comprising the steps of:

(a) providing a plurality of jersey section blocks each having an equal number of feeders as each fleece section block and each attachable to said bed and arranged along the perimeter of said cylinder; and (b) converting said circular knitting machine from producing fleece fabric with said fleece section blocks to producing jersey fabric by replacing said fleece section blocks with said jersey section blocks.

24. A method for converting a circular knitting machine having a creel and feeders from producing fleece fabric, said machine further including: a knitting cylinder for receiving a plurality of knitting needles; a bed for supporting said cylinder; and a plurality of fleece section blocks for attachment to said bed and arranged along of said cylinder at a perimeter thereof; to producing jersey fabric or back, said method comprising the steps of:

(a) providing a plurality of jersey section blocks each having an equal number of feeders and peripheral dimensions as each fleece section block and each attachable to said bed and arranged along the perimeter of said cylinder; and (b) converting said circular knitting machine from producing fleece fabric with said fleece section blocks to producing jersey fabric by replacing said fleece section blocks with said jersey section blocks.

25. A method for converting a circular knitting machine having a creel and feeders from producing fleece fabric, said machine further including: a knitting cylinder for receiving a plurality of knitting needles; a bed for supporting said cylinder; and a plurality of fleece section blocks for attachment to said bed and arranged along of said cylinder at a perimeter thereof; to producing jersey fabric or back, said method comprising the steps of:

(a) providing a plurality of jersey section blocks each having an equal number of feeders and peripheral dimensions as each fleece section block and each attachable to said bed and arranged along the perimeter of said cylinder;

(b) a plurality of fleece sinkers for use with said fleece section blocks for producing fleece fabric and a plurality of jersey sinkers for use with said jersey section blocks for producing jersey fabric; and (c) converting said circular knitting machine from producing fleece fabric with said fleece section blocks to producing jersey fabric by replacing said fleece section blocks with said jersey section blocks and by replacing said fleece sinkers with said jersey sinkers.

* * * * *